US006941899B2

(12) United States Patent
Bradenbaugh

(10) Patent No.: US 6,941,899 B2
(45) Date of Patent: Sep. 13, 2005

(54) ANNULAR FOAM SEAL

(76) Inventor: Kenneth A. Bradenbaugh, 10100 Pinecrest Rd., Concord, OH (US) 44077

( * ) Notice: Subject to any disclaimer, the term of this patent is extended or adjusted under 35 U.S.C. 154(b) by 135 days.

(21) Appl. No.: 10/720,369

(22) Filed: Nov. 24, 2003

(65) Prior Publication Data

US 2005/0109288 A1 May 26, 2005

(51) Int. Cl.[7] ..... F22B 37/36
(52) U.S. Cl. ..... 122/19.2; 122/494
(58) Field of Search ..... 122/19.2, 494; 126/344; 220/567.3, 495.01, 694.1

(56) References Cited

U.S. PATENT DOCUMENTS 4,372,028 A 2/1983 Clark et al.
4,736,509 A 4/1988 Nelson
4,749,532 A 6/1988 Pfeffer
4,878,482 A * 11/1989 Pfeffer ..... 122/19.2
4,890,762 A 1/1990 Pfeffer
4,907,569 A 3/1990 Lemense
4,911,142 A 3/1990 Nelson
4,945,892 A 8/1990 Chevalier et al.
4,956,909 A 9/1990 Nelson
4,957,097 A 9/1990 Chevalier et al.
4,958,620 A 9/1990 Nelson
4,972,967 A 11/1990 Nelson
4,979,637 A 12/1990 Nelson
4,996,759 A 3/1991 Nelson
4,998,970 A 3/1991 Nelson
5,024,210 A 6/1991 Nelson
5,040,697 A * 8/1991 Nelson ..... 220/567.3
5,263,469 A 11/1993 Hickman
5,421,475 A 6/1995 Nelson
5,509,566 A 4/1996 Nelson

* cited by examiner

*Primary Examiner*—Gregory Wilson
(74) *Attorney, Agent, or Firm*—Michael Best & Friedrich LLP

(57) ABSTRACT

A water heater includes a tank and a jacket surrounding the tank. Between the tank and jacket is defined an annular space in which a seal is positioned. The seal extends between the tank and the jacket and defines a bottom of the annular space. The seal includes a depending flange that retains a fiberglass batt against the water tank so that the batt does not interfere with lowering the jacket around the tank. The seal also includes a plurality of arms that center and round out the jacket as it is lowered over the tank. A liquid-based insulation is pumped into the annular space under pressure, and the seal substantially prevents any of the insulation from leaking through the bottom of the annular seal. The arms may be progressively longer and/or thicker from the top down to permit some of the insulation to bypass the upper arms and fill the spaces between the arms.

35 Claims, 5 Drawing Sheets

ANNULAR FOAM SEAL

BACKGROUND

The invention relates to a foam seal for use in an annular space between the water tank and jacket of a water heater or other insulated vessel.

SUMMARY

The present invention provides a water heater that includes a water tank, a jacket surrounding the tank, an annular space between the tank and jacket, a sealing member surrounding an outer surface of the tank and defining the bottom of the annular space, a liquid-based insulation applied under pressure within the annular space, and a fiberglass batt surrounding the tank beneath the sealing member. The sealing member includes at least one wiper member engaging an inner surface of the jacket, and also includes a flange depending from the at least one wiper member. The sealing member substantially prevents the foamable insulation from escaping through the bottom of the annular space. The depending flange of the sealing member holds the batt against the water tank to facilitate installing the jacket over the tank.

The seal may include first, second, and third wiper arms that are progressively longer and/or thicker to provide a progressively higher sealing force against the inner surface of the jacket. The progressively longer arms also round out the jacket as the jacket is lowered over the water tank.

The seal may be extruded from a suitable material, such as polyethylene foam, and cut to length to fit around the water heater. The ends of the seal may be cut to engage one another along a non-vertical interface to resist insulation material from flowing past the seal along the interface of the ends.

Other features and advantages of the invention will become apparent to those skilled in the art upon review of the following detailed description, claims, and drawings.

Figure 1:
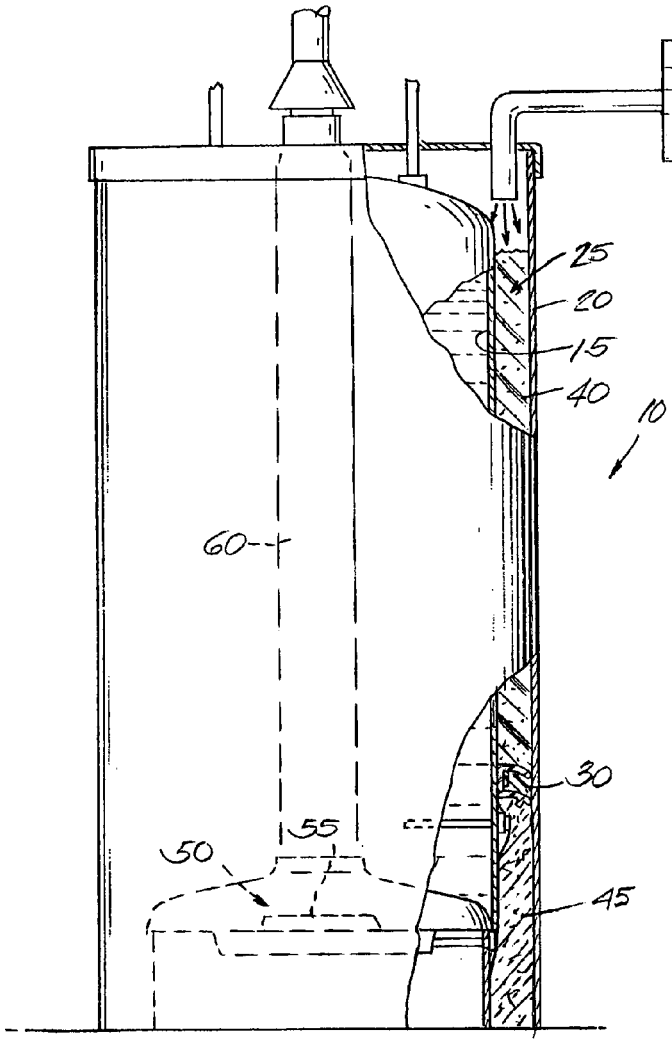
FIG. 1 is a perspective view of a water heater embodying the present invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION

Figure 2:
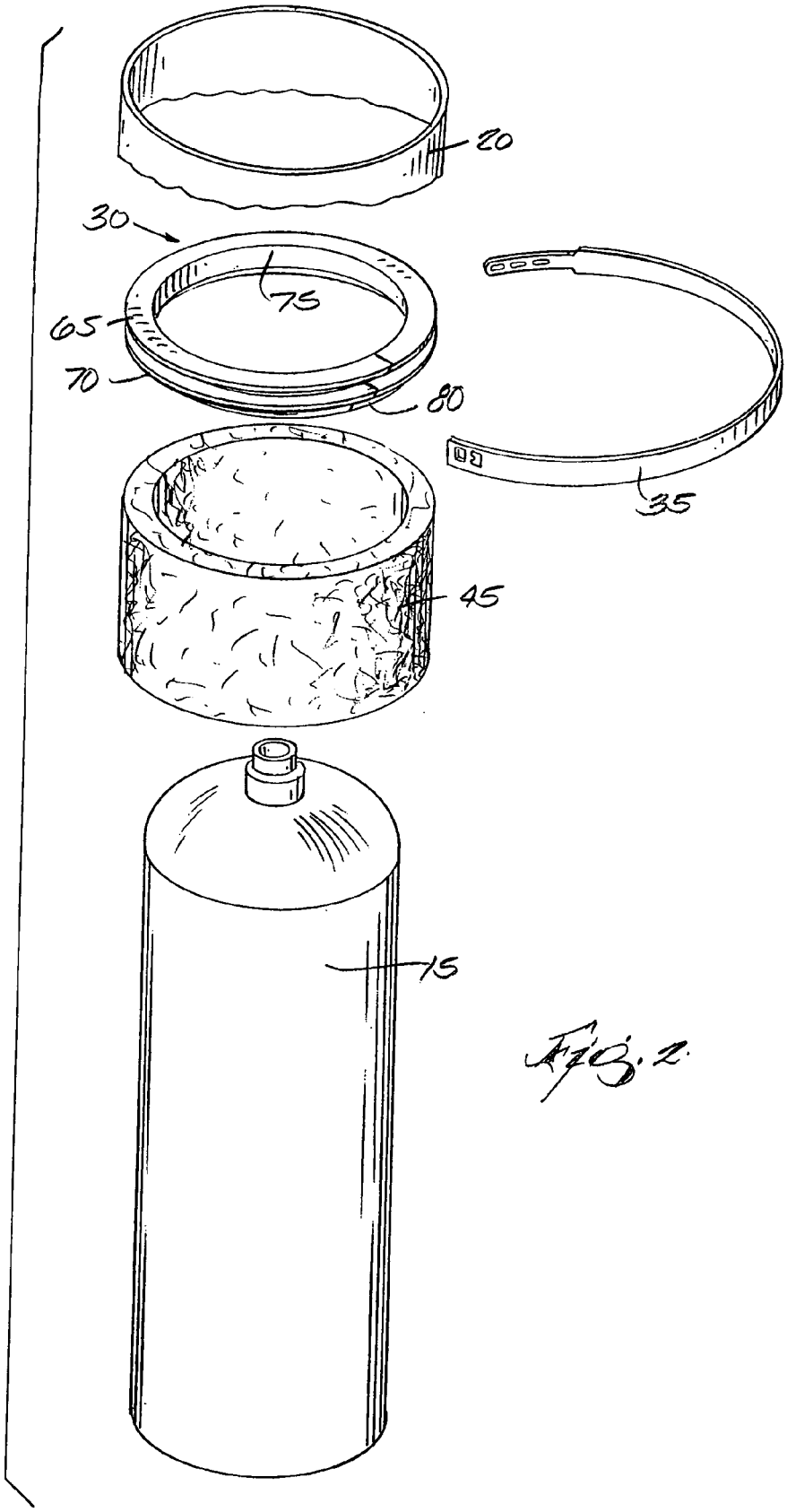
FIG. 2 is an exploded view of the water heater.
Figure 4:
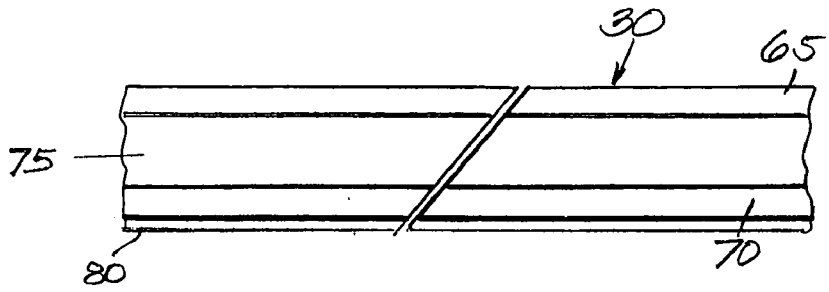
FIGS. 4–7 illustrate various joining configurations for the ends of the sealing
Figure 5:
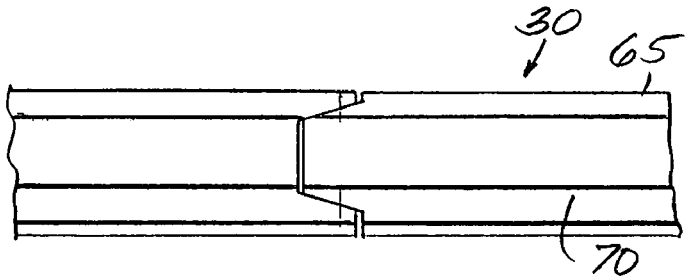
Figure 6:
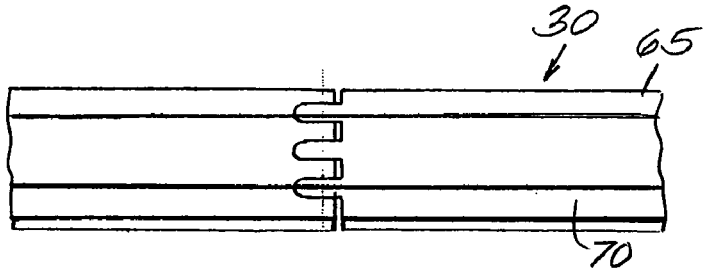
Figure 7:
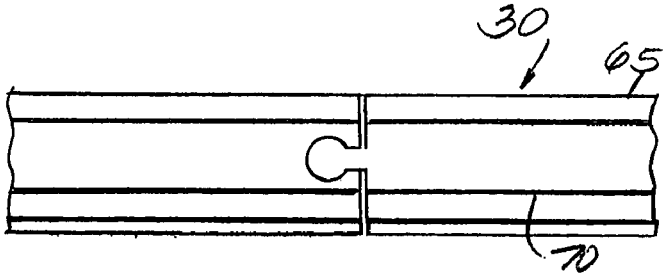

FIGS. 1 and 2 illustrate a water heater 10 including a tank 15, a jacket 20 around the tank 15, an annular space 25 defined between the tank 15 and the jacket 20, a seal 30 defining the bottom of the annular space 25, a belt 35, insulation 40 in the annular space 25, and a fiberglass batt 45 beneath the seal 30. The insulation 40 is preferably a liquid-based material, such as foamable polyurethane, which is cast in place within the annular space 25, but may be substantially any other suitable insulation material.

The illustrated water heater 10 is a storage-type gas-fired water heater and therefore includes a combustion chamber 50 beneath the water tank 15, a burner 55 in the combustion chamber 50, and a flue 60 extending up through the water tank 15 from the combustion chamber 50. The burner 55 combusts a fuel and air mixture to create hot products of combustion that flow up through the flue 60 and heat the water in the tank 15. Because lower-temperature insulation is typically less costly than higher-temperature insulation, and because the combustion chamber 50 portion of the water heater 10 is often much hotter than the tank 15 portion, it is typically most cost efficient to use lower-temperature insulation (e.g., polyurethane) in the annular space 25 and higher-temperature insulation (e.g., the fiberglass batt 45) around the combustion chamber 50 in gas-fired water heaters 10. The seal 30 substantially prevents the lower-temperature insulation 40 from leaking out of the annular space 25 and into the elevated-temperature area around the combustion chamber 50.

The invention is not limited to the illustrated gas-fired water heater 10, and can be used in an electric water heater. In an electric water heater, there is no combustion chamber or flue. Rather, the water heater employs electric heating elements that extend into the water tank. Because there is no combustion chamber in an electric water heater, no fiberglass batt is necessary, and the seal may be positioned level with the lower end of the water tank without fear of melting or otherwise damaging the insulation due to exposure to unacceptably high temperatures. The present invention may also be applied to substantially any application with an insulated storage tank, and should not be regarded as limited to water heater applications only.

Figure 3:
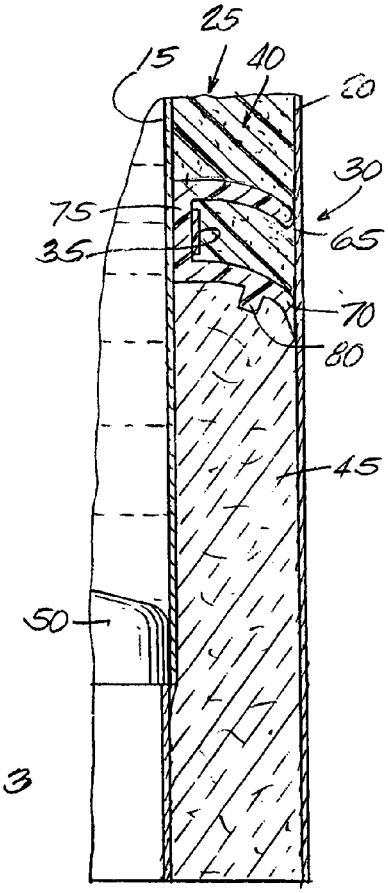
FIG. 3 is cross-sectional view of the lower portion of the water heater.

With reference to FIGS. 2 and 3, the water heater 10 is assembled by wrapping the seal 30 around the water tank 15 at a selected height, cinching the belt 35 around the seal 30 to secure it to the water tank 15, surrounding the portion of the water heater below the seal 30 with the fiberglass batt 45, lowering the jacket 20 around the tank 15 such that the seal 30 engages the inner surface of the jacket 20, and filling the annular space 25 with the insulation material 40. The insulation material 40 is pumped or sprayed into the annular space 25 under pressure to ensure that the annular space 25 is filled with a dense and uniform layer of insulation. The seal 30 substantially prevents the insulation material 40 from flowing through the bottom of the annular space 25.

With reference to FIG. 3, the illustrated seal 30 is extruded from polyethylene foam or another suitable material. Because it is extruded, the seal 30 may be manufactured in long sections and cut to size to fit a particular water tank. The seal 30 has a generally C-shaped cross section having first and second sealing or wiper arms 65, 70 and a web 75 interconnecting the arms 65, 70. The arms 65, 70 and web 75 extend the entire length of the seal 30 and all the way around the tank 15 when installed in the water heater 10.

The belt 35 is received between the arms 65, 70 and against the web 75 to promote a good seal against the water tank 15. The seal 30 may thus be mounted to the tank 15 without the need for adhesive materials. A flange 80 depends from the second arm 70 and is used to restrain the top of the insulation batt 45 from leaning away from the water tank 15 and interfering with installation of the jacket 20 over the tank 15. It therefore may not be necessary in some applications to use an adhesive backing behind the fiberglass batt 45, because the batt 45 is retained in place by the flange 80. In applications where adhesives are not necessary for securing the seal 30 and fiberglass batt 45 against the tank 15, the steps of applying adhesives to those elements are eliminated from the manufacturing process.

The web portion 75 is against the tank 15 and the arms 65, 70 extend out from the tank 15 in a cantilever fashion. The arms 65, 70 extend away from the water tank 15 slightly farther than the width of the annular space 25, such that the arms 65, 70 engage the inner surface of the jacket 20 and are deflected downwardly as the jacket is lowered over the tank 15. The pressure with which the insulation 40 is pumped into the annular space 25 may cause the insulation to leak past the first arm 65, and this is in fact desirable in most applications (where a break in the insulation results in reduced thermal efficiencies).

The seal 30 is preferably designed such that, at the pressure typically used to pump insulation 40 into the annular space 25, some of the insulation 40 is permitted to leak past the first arm 65 and fill the space between the arms 65, 70, but the insulation 40 is not able to bypass the second arm 70. The illustrated seal 30 has substantially identical first and second arms 65, 70, and can achieve the above-described insulation 40 arrangement if the arms 65, 70 are appropriately sized. To facilitate permitting the insulation to breach the seal created by the first arm 65, however, the first arm 65 may be shorter and/or thinner than the second arm 70. Making the first arm 65 shorter than the second arm reduces the sealing force with which the first arm 65 engages the inner surface of the jacket 20. Making the first arm 65 thinner than the second arm 70 renders the first arm 65 less stiff and more easily deflected by the insulation 40.

The ends of the seal 30 may be joined together with a simple butt joint or with one of the more intricate joints illustrated in FIGS. 4–7. Because the seal 30 is extruded of a foam material such as polyethylene, it is easily cut into substantially any length and with ends of substantially any interlocking configuration. If the ends are brought together in a simple butt joint (e.g., a flat vertical interface), the entire downward force of the insulation 40 will be applied along the joint and may cause the insulation 40 to leak through the joint. It is therefore preferable to employ a sealant between the ends or to heat seal the ends together if a simple butt joint is employed. However, if the ends of the seal 30 are mitered, mortised, or otherwise engaged in a non-vertical joint as illustrated in FIGS. 4–7, no sealant or heat sealing is necessary. This is because the joints provide a non-vertical interface between the ends that is not as susceptible to leakage from the vertically-applied forces of the insulation 40. The joints illustrated in FIGS. 4–7 are not intended to be limiting, and substantially any non-vertical joint is suitable, whether having a flat interface (as in FIG. 4) or a circuitous, interlocking interface (as in FIGS. 5–7).

FIGS. 8–11 illustrate an alternative configuration of the seal 30 which includes first, second, and third arms 85, 90, 95 that are progressively longer and thicker. As with the configuration discussed above, the arms extend in a cantilever fashion from a web 75. In this configuration, a second belt 35 may be used to secure the web portion 75 to the tank 15.

Figure 8:
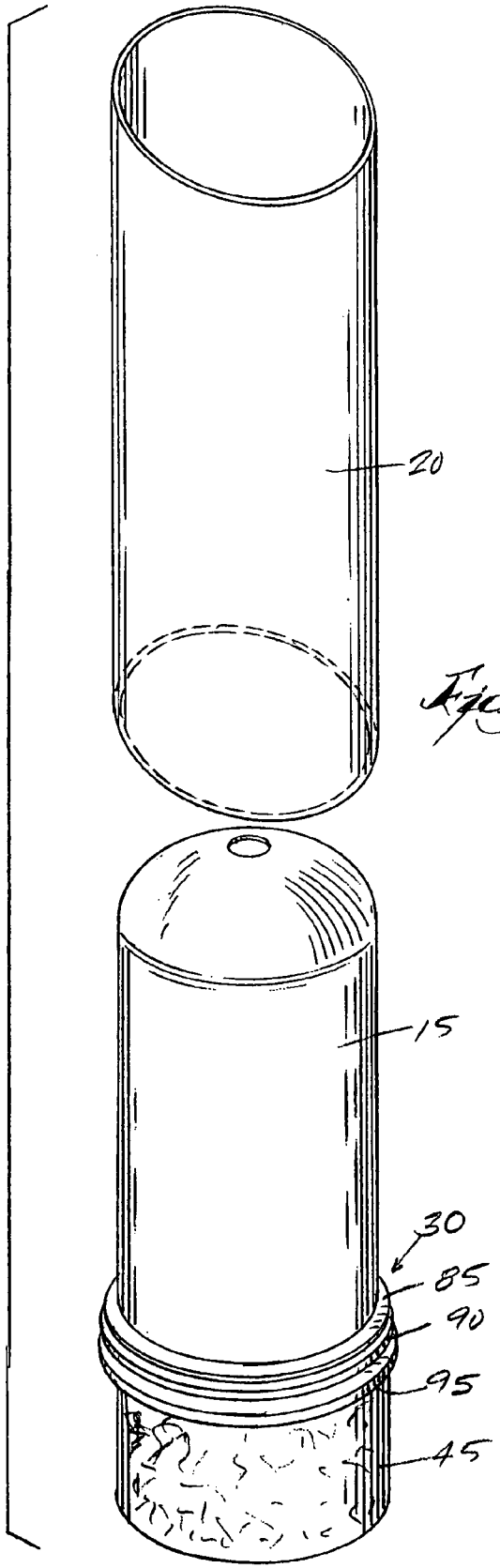
FIG. 8 is an exploded view of the water heater with an alternative seal.
Figure 9:
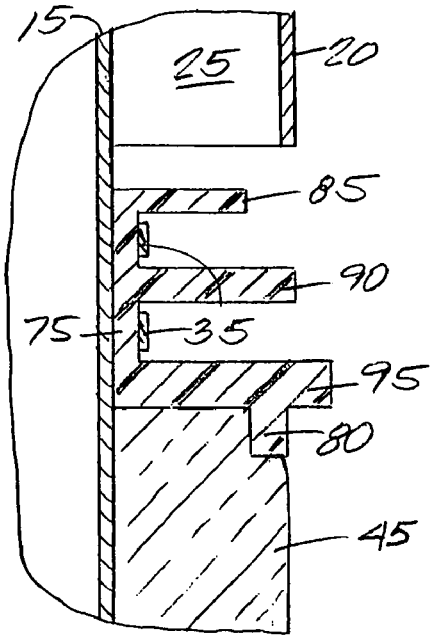
FIGS. 9–11 are cross-section views of a portion of the water heater of claim 8, illustrating the jacket being installed over the tank.
Figure 10:
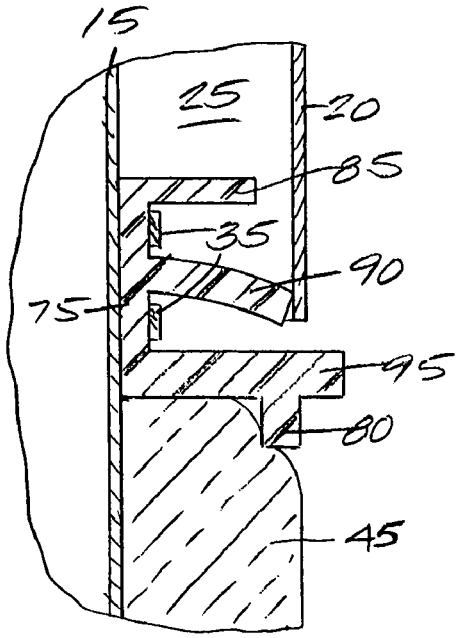
Figure 11:
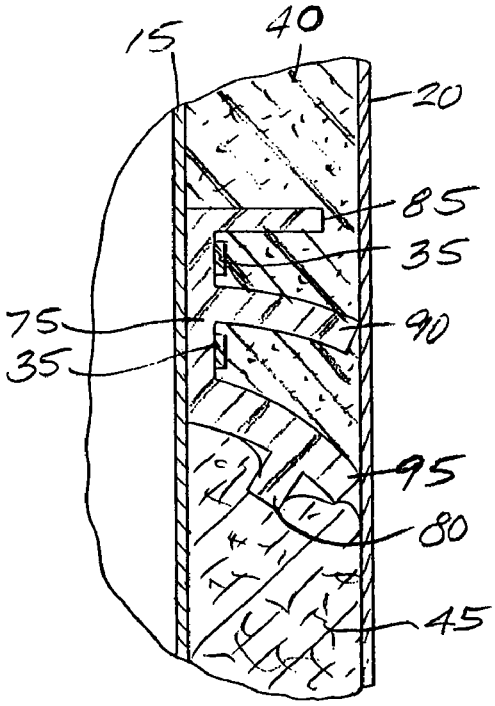

This seal configuration is particularly useful during assembly when the jacket 20 is not circular (references to the shape of the jacket 20 will be understood as references to the horizontal cross-sectional shape of the jacket 20). For example, the jacket 20 illustrated in FIG. 8 is generally oval. The first arm 85 may not even engage the jacket 20 at all when the jacket 20 is circular. But if the jacket 20 is severely out of shape, portions of the jacket may engage the first arm 85 upon initial contact. The first and second arms 85, 90 center and "round out" the jacket 20 before the third arm 95 engages the jacket 20. As used herein, the term "round out" means changing the shape of a non-circular jacket 20 into a shape that is closer to a circle. The arms 85, 90, 95 progressively round out the jacket 20 and center the jacket 20 around the tank 15 as the jacket 20 is lowered over tank 15. Thus, the jacket 20 is not met with the large resistance it would encounter if an uncentered and non-circular jacket 20 were lowered directly onto the third arm 95.

The seal 30 is preferably designed such that, at the pressure typically used to pump insulation 40 into the annular space 25, some of the insulation 40 is permitted to leak past the first and second arms 85, 90 and substantially fill the spaces between the arms 85, 90, 95. The third arm 95 is designed to resist flow of the insulation 40 through the bottom of the annular space 25. The arms 85, 90, 95 may be progressively thicker and longer as illustrated or may only increase in length or thickness from the first to third arms. The arms 85, 90, 95 may alternatively be of the same length and thickness as long as the insulation 40 is able to leak past the first and second arms 85, 90 and as long as the arms 85, 90, 95 do not create unacceptably high resistance to the lowering of the jacket around the tank 15. It should be noted that more than three arms 85, 90, 95 may be employed if a slower progression or rounding-out of the jacket 20 is needed.

The seal 30 illustrated in FIGS. 8–11 may also be extruded from polyethylene foam or another suitable material, and cut to lengths suitable for a particular water tank. The ends may also be cut into the configurations illustrated in FIGS. 4–7, or other non-vertical joint configurations. As with the configuration discussed above, a simple butt joint may be employed, but it is preferred that the ends be sealed together with adhesive or with a heat seal if a simple butt joint is used.

What is claimed is:

1. A water heater comprising:

a water tank;

a jacket surrounding the tank;

an annular space between the tank and jacket;

a sealing member surrounding an outer surface of the tank and defining the bottom of the annular space, the sealing member including at least one wiper member engaging an inner surface of the jacket, the sealing member also including a flange depending from the at least one wiper member;

a liquid-based insulation applied under pressure within the annular space, the sealing member substantially preventing the insulation from escaping through the bottom of the annular space; and a fiberglass batt surrounding the tank beneath the sealing member and held against the tank by the depending flange of the sealing member.

2. The water heater of claim 1, wherein the sealing member includes first and second ends that interlock with one another along a non-vertical interface to assist in preventing the insulation from bypassing the sealing member.

3. The water heater of claim 1, wherein the at least one wiper member of the sealing member includes first and second wiper members and a web interconnecting the first and second wiper members.

4. The water heater of claim 3, wherein the web is against the tank and the first and second wiper members extend away from the web and tank in a cantilever fashion.

5. The water heater of claim 3, further comprising a band surrounding the tank, engaging the web, and securing the sealing member to the tank with a compressive force.

6. The water heater of claim 3, wherein the second wiper member is below the first wiper member and wherein the flange depends from the second wiper member and engages the top of the fiberglass batt to restrain the fiberglass bat from leaning away from the tank beyond the end of at least one of the first and second wiper members.

7. The water heater of claim 3, wherein the second wiper member is below the first wiper member and wherein the second wiper member is longer than the first wiper member.

8. The water heater of claim 3, wherein the second wiper member is below the first wiper member and wherein the second wiper member is thicker than the first wiper member.

9. A sealing member for a tank, jacket, and insulating batt assembly, the sealing member defining a bottom end to an annular space between the tank and jacket, the sealing member being adapted to mount to an outer surface of the tank, the sealing member comprising:

at least one arm sealingly engaging an inner surface of the jacket and operable to substantially prevent the foamable insulation from escaping through the bottom of the annular space; and a flange depending from the at least one arm and operable to hold the top of the insulating batt against the tank and beneath the sealing member.

10. The sealing member of claim 9, wherein the sealing member includes a web and wherein the at least one arm includes first and second arms extending in cantilever fashion away from the web.

11. The sealing member of claim 9, wherein the at least one arm includes first and second arms, wherein the first arm is above the second arm, and wherein the flange depends from the second arm.

12. The sealing member of claim 9, wherein the at least one arm includes first and second arms, wherein the first arm is above the second arm, and wherein the second arm is longer than the first arm.

13. The sealing member of claim 9, wherein the at least one arm includes first and second arms, wherein the first arm is above the second arm, and wherein the second arm is thicker than the first arm.

14. The sealing member of claim 9, further comprising first and second ends that interlock with one another along a non-vertical interface to assist in preventing the foamable insulation from bypassing the sealing member.

15. A water heater comprising:

a water tank;

a jacket surrounding the tank;

an annular space between the tank and jacket;

a sealing member surrounding an outer surface of the tank and defining the bottom of the annular space, the sealing member having first, second, and third wiper members, the second wiper member extending away from the tank further than the first wiper member and the third wiper member extending away from the tank further than the second wiper member, at least the third wiper member engaging an inner surface of the jacket; and foamable insulation within the annular space, the sealing member substantially preventing the foamable insulation from escaping through the bottom of the annular space.

16. The water heater of claim 15, wherein the first and second arms center the jacket on the water heater and progressively deform the jacket into a substantially circular cross sectional shape as the jacket is lowered over the tank during water heater assembly.

17. The water heater of claim 15, wherein the second arm is thicker than the first arm and the third arm is thicker than the second arm.

18. The water heater of claim 15, wherein the sealing member includes first and second ends that interlock with one another along a non-vertical interface to assist in preventing the foamable insulation from bypassing the sealing member.

19. The water heater of claim 15, wherein the third arm applies a higher seal force against the inner surface of the jacket than either of the first and second arms.

20. A sealing member for defining a bottom end to an annular space between a tank and a jacket surrounding the tank, the sealing member comprising:

a web adapted for mounting on an outer surface of the tank; and first, second, and third arms extending away from the web;

wherein the first arm is above the second arm, and the second arm is above the third arm;

wherein the second arm extends further away from the web than the first arm, and the third arm extends further away from the web than the second arm; and wherein at least the third arm is sized to extend across the annular space and engage an inner surface of the jacket.

21. The sealing member of claim 20, wherein the second arm is thicker than the first arm, and wherein the third arm is thicker than the second arm.

22. The sealing member of claim 20, further comprising a flange depending from the third arm and operable to retain the top of an insulating batt against the water tank during installation of the jacket around the tank.

23. The sealing member of claim 20, further comprising first and second ends that interlock with one another along a non-vertical interface to assist in preventing the foamable insulation from bypassing the sealing member.

24. A method for assembling a water heater comprising:

providing a water tank;

providing a sealing member having at least one arm and depending flange;

providing an insulating batt;

providing a jacket;

providing a volume of liquid foamable insulation;

securing the sealing member around the circumference of an outer surface of the water tank;

wrapping the portion of the water tank below the sealing member with the insulating batt;

retaining the top of the batt against the water tank with the flange;

positioning the jacket around the water tank to define an annular space therebetween;

engaging an inner surface of the jacket with the at least one arm of the sealing member to define the bottom of the annular space;

introducing the liquid foamable insulation into the annular space; and containing the insulation within the annular space with the at least one arm of the sealing member.

25. The method of claim 24, wherein the providing a sealing member step includes extruding the sealing member.

26. The method of claim 25, wherein the providing a sealing member step further includes extruding the sealing member from polyethylene.

27. The method of claim 24, wherein the at least one arm of the sealing member includes first and second arms; wherein the flange depends from the second arm; and wherein the step of securing the sealing member includes positioning the first arm above the second arm.

28. The method of claim 27, wherein the step of providing a sealing member includes making the second arm longer than the first arm; and wherein the step of engaging the inner surface includes engaging the inner surface of the jacket with at least the second arm of the sealing member.

29. The method of claim 27, wherein the step of providing a sealing member includes making the second arm thicker than the first arm.

30. The method of claim 27, wherein the containing the insulation step includes permitting a quantity of the insulation to bypass the first arm and fill a space between the first and second arms, but substantially preventing any insulation from bypassing the second arm.

31. A method of assembling a water heater having a generally cylindrical water tank, and a jacket having a non-circular cross section and adapted to surround the tank, the method comprising the steps of:

providing a sealing member having first, second, and third arms, the third arm being longer than at least one of the first and second arms;

attaching the sealing member to an outer surface of the tank with the first arm above the second arm and the third arm below the second arm;

lowering the jacket around the tank;

engaging the jacket with the first and second arms as the jacket is lowered over the sealing member;

bringing the jacket into a generally circular shape in response to the first and second arms engaging the jacket;

engaging an inner surface of the jacket with the third arm and forming a seal between the third arm and the jacket;

defining an annular space between the tank and jacket and defining a bottom of the annular space with the third arm;

filling the annular space with insulation; and resisting the escape of insulation through the bottom of the annular space with the sealing member.

32. The method of claim 31, wherein the providing a sealing member step includes extruding the sealing member.

33. The method of claim 32, wherein the providing a sealing member step further includes extruding the sealing member from polyethylene.

34. The method of claim 31, wherein the step of providing a sealing member includes making the third arm thicker than at least one of the first and second arms.

35. The method of claim 31, wherein the resisting the escape step includes permitting a quantity of the insulation to bypass the first and second arms and filling a space between the first and second arms and a space between the second and third arms, but substantially preventing any insulation from bypassing the third arm.

* * * * *